US008257033B2

(12) United States Patent
Oishi

(10) Patent No.: US 8,257,033 B2
(45) Date of Patent: Sep. 4, 2012

(54) PRODUCTION METHOD OF STATOR BLADE AND TURBO-MOLECULAR PUMP WITH THE STATOR BLADE

(75) Inventor: Kouta Oishi, Kyoto (JP)

(73) Assignee: Shimadzu Corporation, Kyoto-Fu (JP)

( * ) Notice: Subject to any disclaimer, the term of this patent is extended or adjusted under 35 U.S.C. 154(b) by 1162 days.

(21) Appl. No.: 12/061,153

(22) Filed: Apr. 2, 2008

(65) Prior Publication Data

US 2008/0317590 A1 Dec. 25, 2008

(30) Foreign Application Priority Data

Jun. 21, 2007 (JP) ..... 2007-163950

(51) Int. Cl.
*F04D 29/44* (2006.01)

(52) U.S. Cl. ..... 415/191; 415/58.5; 29/889.4

(58) Field of Classification Search ..... 415/90, 415/191, 193, 199.2, 199.3, 199.5, 52.1, 415/58.4, 58.5; 29/889.4, 889.3, 889
See application file for complete search history.

(56) References Cited

U.S. PATENT DOCUMENTS

2006/0280595 A1* 12/2006 Stoll ..... 415/90

FOREIGN PATENT DOCUMENTS

| | | | |
|---|---|---|---|
| JP | 03142086 A | * | 6/1991 |
| JP | 06-285662 A | | 10/1994 |
| JP | 10-015685 A | | 1/1998 |
| JP | 11-163056 A | | 6/1999 |
| JP | 2003-269365 A | | 9/2003 |
| WO | 2007/004542 A | | 1/2007 |

OTHER PUBLICATIONS

Japanese Office Action issued in corresponding Japanese Application No. 2007-163950 dated Oct. 13, 2011. English Translation.

* cited by examiner

*Primary Examiner* — Dwayne J White
(74) *Attorney, Agent, or Firm* — Sughrue Mion, PLLC

(57) ABSTRACT

Disclosed is a method of producing a stator blade for use in a turbo-molecular pump. The method includes subjecting a metal plate to a slitting process to form a blade element having an upstream edge surface and a downstream edge surface, wherein a laser beam is emitted onto the metal plate at an incident angle oblique to a principal surface of the metal plate. Thus, the upstream edge surface and/or the downstream edge surface can be formed to extend obliquely relative to the principal surface of the metal plate, in a simple manner, while eliminating a need for a burr removal operation which would otherwise be necessary in a punching-based slitting process.

1 Claim, 8 Drawing Sheets

PRODUCTION METHOD OF STATOR BLADE AND TURBO-MOLECULAR PUMP WITH THE STATOR BLADE

BACKGROUND OF THE INVENTION

1. Field of the Invention

The present invention relates to a method of producing a stator blade for use in a turbo-molecular pump for an evacuation purpose, and a turbo-molecular pump having the stator blade.

2. Description of the Related Art

A turbo-molecular pump designed for a high level of evacuation is provided with a plurality of rotor blades arranged in a multistage manner and a plurality of stator blades arranged in a multistage manner. Each of the rotor blades comprises a plurality of blade elements each formed to extend around an entire circumference of a rotor while protruding from an outer peripheral surface of the rotor. Each of the stator blades comprises a plurality of blade elements each arranged to surround the rotor, wherein each of the blade elements is connected to an arc-shaped strip member at an outer peripheral edge surface and/or an inner peripheral edge surface thereof. Generally, the stator blade in each stage is made up of a pair of semicircular-shaped blade segments. Each of the stator blades is disposed between adjacent ones of the rotor blades arranged along an axial direction of the rotor, whereby an evacuation action is produced when the rotor blades are rotated relative to the stator blades at a high speed according to rotation of the rotor.

Heretofore, as a method of fabricating such stator blades, there has been known a technique of subjecting a semicircular-shaped metal plate to a punching process to form a plurality of blade elements each supported by inner and outer peripheral ribs, and subjecting the blade elements to an angling process to obtain a stator blade. In the angling process, each of the blade elements having a rectangular vertical-section is angled and positioned in an obliquely inclined posture. Thus, each of upper and lower edge surfaces of the obliquely-inclined blade element is positioned to have a chevron shape protruding in the axial direction of the rotor, which leads to a problem about an increase in overall size of the pump.

As measures for this problem, there has been proposed a production method designed to slidingly move a punch relative to a plate in an oblique direction during a punching process so as to allow a blade element after being subjected to an angling process to be position to have horizontally-extending upper and lower edge surfaces (see, for example, JP 2003-269365A).

In cases where a metal plate is subjected to a punching process using a punch, a burr is highly likely to be formed during punching, and thereby it is necessary to additionally perform a burr removal operation. If a thicker metal plate is used to ensure the rigidity of a stator blade, a fabrication cost will be further increased. Moreover, in the above method, a desired sliding direction during the oblique sliding movement of the punch is different between a plurality of blade elements to be formed in the metal plate. Thus, it is extremely difficult to form all the blade elements by one cycle of punching operation, which will accelerate an increase in fabrication cost.

SUMMARY OF THE INVENTION

In view of the above circumstances, it is an object of the present invention to provide a method of producing a stator blade for use in a turbo-molecular pump, which is capable of forming a blade element having a desirable configuration, in a simple manner, while suppressing an increase in fabrication cost.

It is another object of the present invention to provide a turbo-molecular pump comprising a stator blade produced by the method.

In order to achieve the above objects, the present invention provides a method of producing a stator blade for use in a turbo-molecular pump. The method comprises a slitting step of subjecting a metal plate to a slitting process using a laser beam to form therein an arc-shaped support portion and a blade element supported by the support portion, and an angling step of angling the blade element formed in the slitting step, relative to the support portion, to provide a blade angle to the blade element, wherein the slitting step includes emitting the laser beam onto the metal plate at an incident angle oblique to a principal surface of the metal plate to allow the blade element to have an upstream edge surface and/or a downstream edge surface extending obliquely relative to the principal surface of the metal plate.

When the blade element is a twisted blade element, the incident angle of the laser beam oblique to the principal surface of the metal plate may be set to be different between inner and outer peripheral regions of the upstream edge surface and/or the downstream edge surface of the twisted blade element.

A turbo-molecular pump comprising a stator blade can be produced by the method set forth above.

In the method of the present invention, the laser beam is emitted onto the metal plate at an incident angle oblique to the principal surface of the metal plate. This makes it possible to form a blade element having an upstream edge surface and/or a downstream edge surface extending obliquely to the principal surface of the metal plate, in a simple manner, while suppressing an increase in fabrication cost.

In addition, a turbo-molecular pump comprising a stator blade produced by the method of the present invention can avoid an increase in size due to the configuration of a blade element.

BRIEF DESCRIPTION OF THE DRAWINGS

FIGS. 3A and 3B are schematic diagrams for explaining a production method of the stator blade 2B in FIG. 2, wherein FIG. 3A shows a first step, and FIG. 3B shows a second step.

FIGS. 4A and 4B are schematic diagrams for explaining a beam angle in a lasering-based slitting process, wherein FIG. 4A shows a beam angle for a twistable portion in a metal plate, and FIG. 4B shows a beam angle for an upstream edge surface and a downstream edge surface of a blade element 200 in the metal plate.

DESCRIPTION OF THE EXEMPLARY EMBODIMENTS

Figure 1:
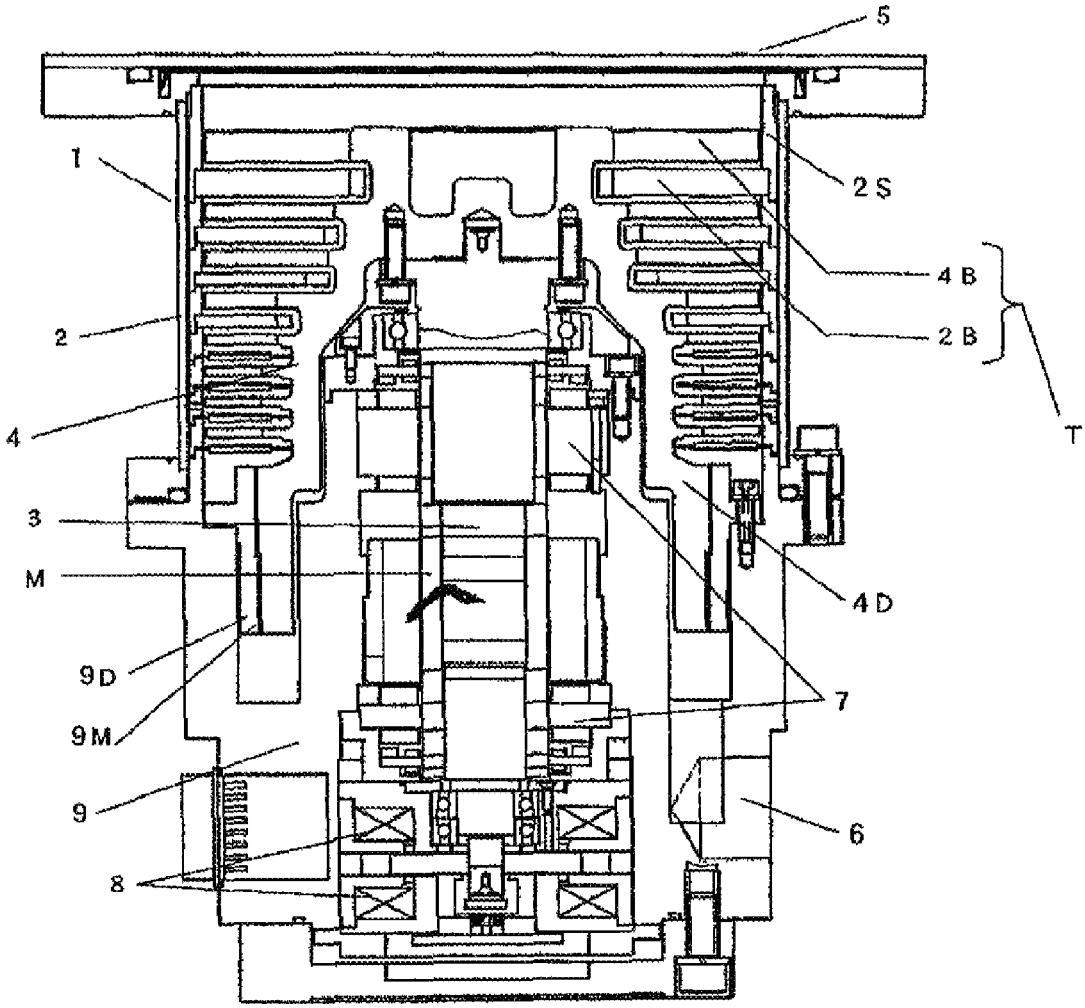
FIG. 1 is a schematic sectional view showing a turbo-molecular pump according to one embodiment of the present invention.

With reference to the drawings, the present invention will now be specifically described based on the most preferred embodiment thereof. FIG. 1 is a schematic sectional view showing a pump body 1 of a turbo-molecular pump according to one embodiment of the present invention. The turbo-molecular pump comprises the pump body 1 and a controller (not shown) for supplying a power to the pump body 1 to control rotational driving of the pump body 1.

The pump body 1 includes a casing 2, a rotor 4 disposed inside the casing 2, and a rotary shaft 3 fastened to the rotor 4 using a bolt. The rotary shaft 3 is adapted to be supported by a pair of upper and lower radial magnetic bearings 7 and a thrust magnetic bearing 8, in a non-contact manner, and rotationally driven by a motor M. The rotor 4 is formed with a rotor cylinder 4D and provided with a plurality of rotor blades arranged in a multistage manner. Correspondingly, a plurality of stator blades 2B arranged in a multistage manner are disposed inside the casing 2 while being vertically clamped between adjacent ones of a plurality of spacers 2S attached to an inner surface of the casing 2 in a stacked manner. A stator cylinder 9D formed with a spiral groove 9M in an inner peripheral surface thereof is disposed below the plurality of stator blades 2B.

In the turbo-molecular pump illustrated in FIG. 1, an upstream stator blade group, i.e., the four stator blades 2B in 1st to 4th stages, and a downstream stator blade group, i.e., the four stator blades 2B in 5th to 8th stages, are different from each other in production method. Specifically, each of the four upstream stator blades has a plurality of blade elements each formed by subjecting a metal plate made, for example, of aluminum alloy or stainless steel, to a cutting process to have a relatively large blade angle and a relative larger blade height. In contrast, each of the four downstream stator blades has a plurality of blade elements each formed by subjecting a metal plate to an angling process to have a relatively small blade angle and a relative small blade height. In this embodiment, the production method of the downstream stator blades 2B has a distinctive feature, as will be described later.

The plurality of rotor blades 4B and the plurality of stator blades 2B are alternately arranged in an axial direction of the rotor 4 to form a turbine blade section T. The rotor cylinder 4D and the stator cylinder 9D are combined together to form a molecular drag pump section 9. Specifically, the rotor cylinder 4D is disposed in adjacent relation to the inner peripheral surface of the stator cylinder 9D formed with the spiral groove 9M. The molecular drag pump section 9 has an evacuation function produced based on a viscous flow to be formed by the spiral groove 9M of the stator cylinder 9D and the rotor cylinder 4D adapted to be rotated at a high speed.

The turbo-molecular pump designed to couple the turbine blade section T and the molecular drag pump section 9 as shown in FIG. 1 is called "Wide range turbo-molecular pump". Gas entering from an inlet port 5 is pushed downwardly (toward a downstream side) by the turbine blade section T, and discharged from the turbine blade section T toward the downstream side. Then, the gas is further compressed by the molecular drag pump section 9, and then discharged from an outlet port 6.

Figure 2:
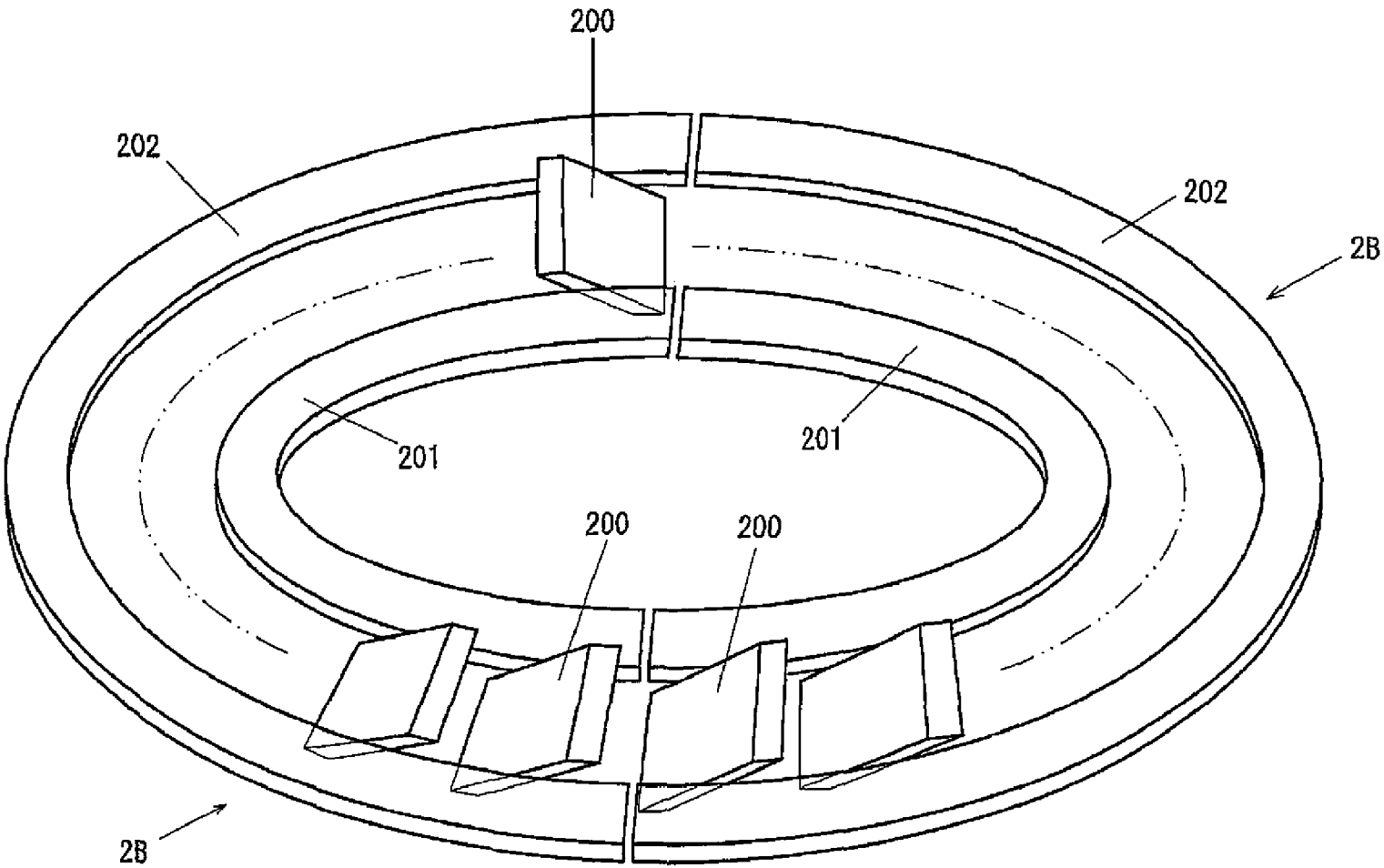
FIG. 2 is a perspective view showing a stator blade 2B for use in the turbo-molecular pump in FIG. 1.

FIG. 2 is a perspective view showing one of the four downstream stator blades 2B formed by an angling process. The stator blade 2B in each of the downstream stator blade group is formed of a pair of half ring-shaped stator blades (each of the half ring-shaped stator blades will hereinafter be referred to as "stator blade 2B" except as otherwise noted). The stator blade 2B has an inner peripheral rib portion 201, an outer peripheral rib portion 202, and a plurality of blade elements 200 disposed between the inner and outer peripheral rib portions 201, 202 and aligned along an arc line. The stator blade 2B is held inside the pump by vertically clamping the outer peripheral rib portion 202 between adjacent ones of the spacers 2S. Although not illustrated in FIG. 2, each of the blade elements 200 is supported by the inner and outer peripheral rib portions 201, 202 through two narrow twistable portions 203 (see FIG. 3B). The twistable portions 203 are twisted during an angling process for the blade element 200, to provide a given blade angle to the blade element 200.

[Production Method of Stator Blade 2B]

With reference to FIGS. 3A to 5B, the production method of the stator blade 2B will be described. In a first step illustrated in FIG. 3A, a metal plate 100 is subjected to a punching process to form a half ring-shaped plate 101. In a second step illustrated in FIG. 3B, the half ring-shaped plate 101 is subjected to a lasering-based slitting process to form a plurality of slit regions 102 indicated as shaded regions. Consequently, a plurality of blade elements 200, an inner peripheral rib portion 201, an outer peripheral rib portion 202 and a plurality of twistable portions 203 are formed in the half ring-shaped plate 101.

Figure 3A:
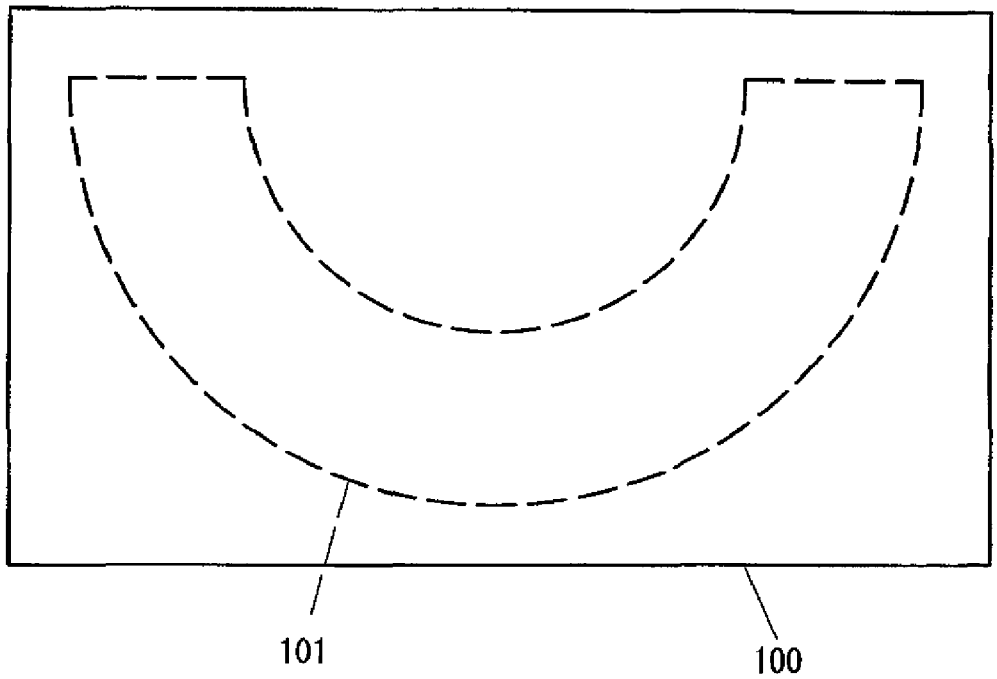
Figure 3B:
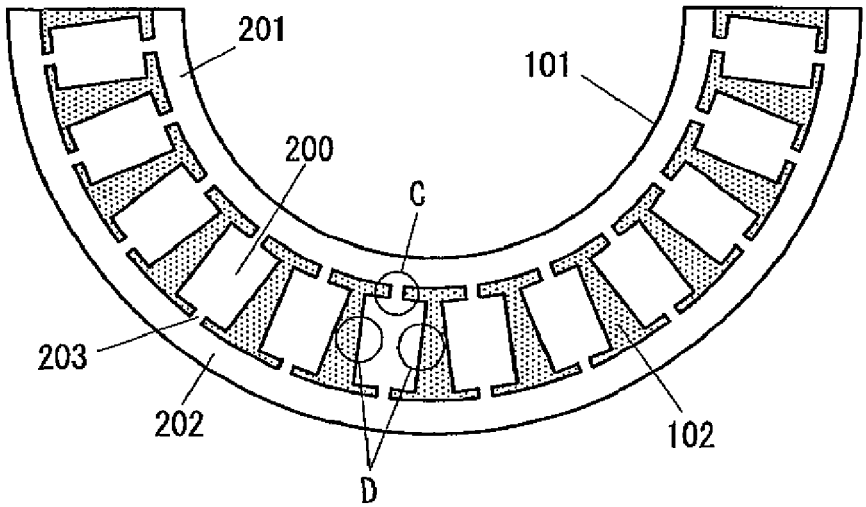
Figure 4A:
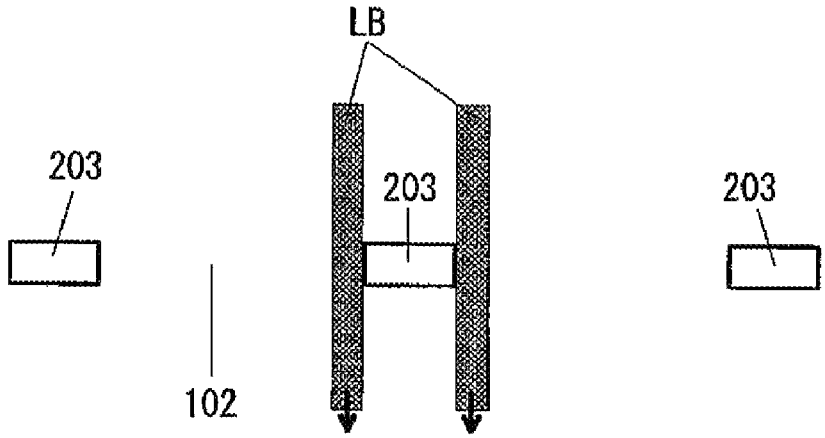
Figure 4B:
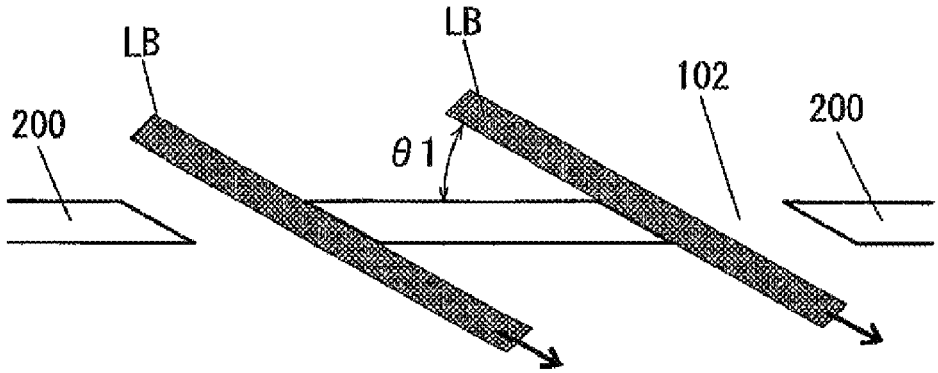

FIG. 4A shows an angle of a laser beam LB during the slitting process for the twistable portion 203 indicated by the circle C in FIG. 3B. In the laser beam-based slitting process, during a course of forming a profile of the twistable portion 203, the laser beam LB is emitted onto the half ring-shaped plate 101 at an incident angle perpendicular to a principal surface (i.e., front and rear surfaces) of the half ring-shaped plate 101 (i.e., at a beam angle of 90 degrees). During a course of forming a profile of each of the inner and outer peripheral rib portions 201, 202, and inner and outer peripheral edge surfaces of each of the blade elements 200, the beam angle is set at 90 degrees in the same manner as that for the twistable portion 203.

Differently, during a course of forming an upstream (upper) edge surface and a downstream (lower) edge surface of the blade element (indicated by the circles D in FIG. 3B), the laser beam LB is emitted onto the half ring-shaped plate 101 at an incident angle oblique to the principal surface of the half ring-shaped plate 101 (i.e., at a beam angle $\theta 1$). Consequently, each of the upstream and downstream edge surfaces formed by the slitting process using the laser beam LB extends at the angle $\theta 1$ to front and rear surfaces of the blade element 200.

Figure 5B:
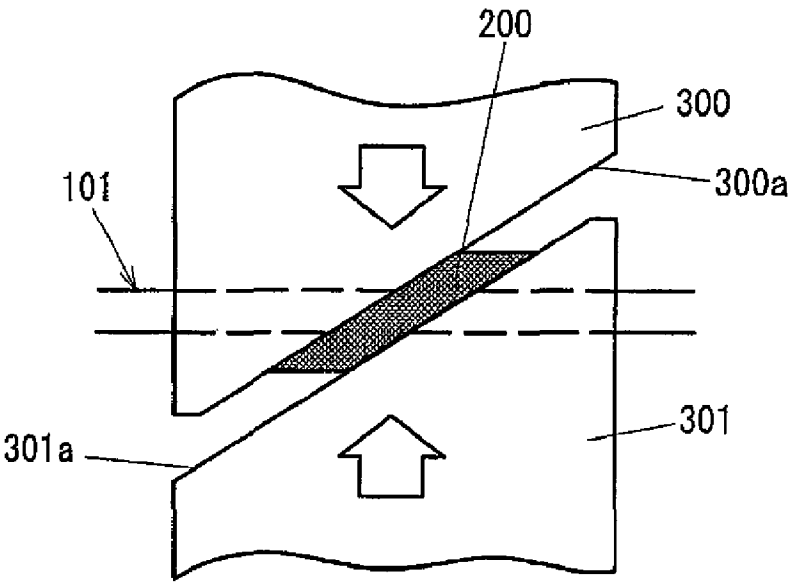
FIGS. 5A and 5B are schematic diagrams for explaining an angling process for the blade element 200, in a third step.
Figure 5A:
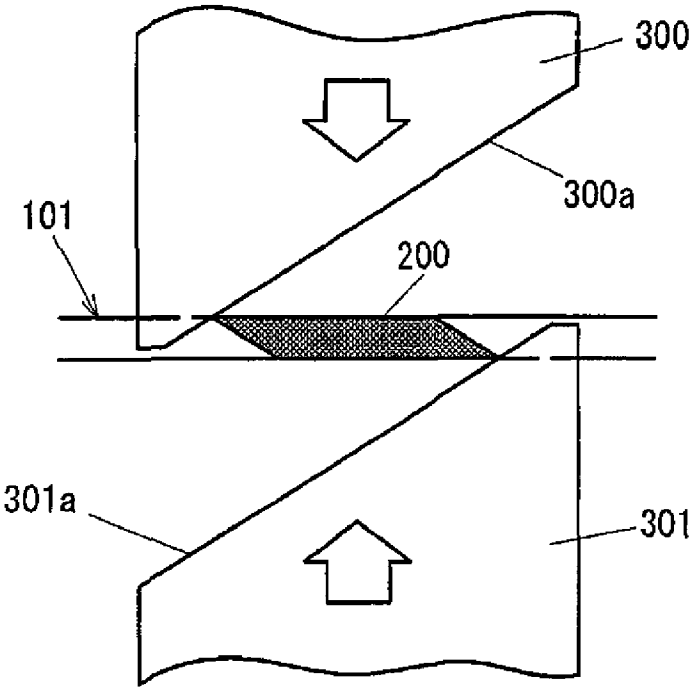

FIGS. 5A and 5B are schematic diagrams for explaining a third step, i.e., an angling process for the blade element 200. In this embodiment, the angling process is performed through a pressing operation. Specifically, as shown in FIGS. 5A and 5B, downstream and upstream edges of the blade elements 200 are pressed by upper and lower punch 300, 301 in downward and upward directions, respectively. Respective pressing surfaces 300*a*, 301*a* of the upper and lower punches 300, 301 are inclined in conformity to a given blade angle of the blade element 200. When the blade element 200 in a horizontal posture (see FIG. 5A) is pressed by the upper and lower punches 300, 301 respectively in the downward and upward directions, the twistable portion 203 illustrated in FIG. 3B is twisted to provide the given blade angle to the blade element 200.

Figure 6A:
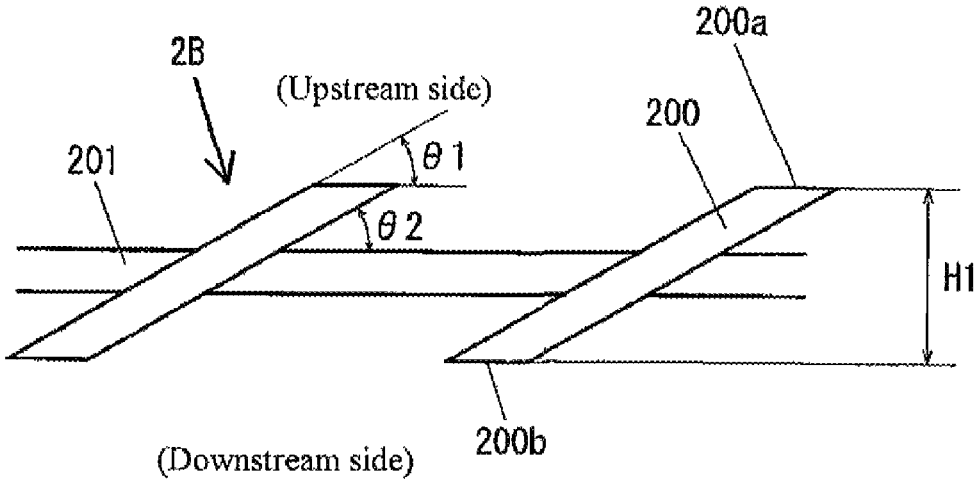
FIGS. 6A and 6B are schematic diagrams for comparing between the blade element 200 of the stator blade 2B, and a blade element 400 having a chevron-shaped end.

FIG. 6A is a schematic diagram showing the blade element 200 after being subjected to the angling process. Through the angling process, the blade angle of the blade element 200 is set at θ2. Each of an angle of the upper (i.e., upstream) edge surface 200*a* with respect to the front surface of the blade element 200, and an angle of the lower (i.e., downstream) edge surface 200*b* with respect to the rear surface of the blade element 200, is equal to the beam angle θ1 of the laser beam LB illustrated in FIG. 4B. In the example illustrated in FIG. 6A, the angle θ1 is set to be equal to the angle θ2, and thereby the upper edge surface 200*a* of the blade element 200 is positioned to extend horizontally (i.e., parallel to the inner peripheral rib portion 201). The blade element 200 has a blade height of H1.

Figure 6B:
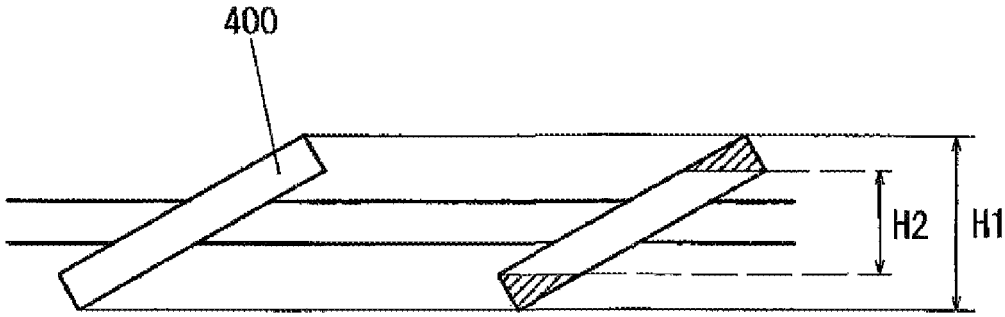

As a comparative example, FIG. 6B shows the configuration of a blade element 400 obtained by forming a plurality of slit regions 102 by a punching-based slitting process at a punching angle perpendicular to the principal surface of the half ring-shaped plate 101. It is understood that the blade element 400 is equivalent to a blade element obtained by a lasering-based slitting process at a beam angle θ1 of 90 degrees. In the comparative example, each of upper and lower edge surfaces of the blade element 400 is positioned to have a chevron shape protruding in the axial direction of the rotor (in FIG. 6B, in a vertical direction). The shaded chevron-shaped portion repels gas molecules toward the inlet port, and has almost no contribution to the evacuation action. This means that the chevron-shaped portion of the blade element 400 is a dead space. Specifically, converting to configuration of the blade element 200 illustrated in FIG. 6A, the blade element 400 can achieve an evacuation function only at a level equivalent to a blade element having a blade height of H2. That is, a blade element having the configuration as illustrated in FIG. 6A makes it possible to reduce a blade height of the stator blade 2B and thereby reduce an axial dimension of the pump body 1.

In the example illustrated in FIG. 6A, the angle θ1 is set to be equal to the θ2 so as to allow the upper edge surface to be positioned to extend horizontally. Practically, it is not essential to set the angle θ1 to be exactly equal to the θ2, but the angle θ1 may be set to be less than the θ2. In this case, the downstream edge surface 200*b* of the blade element 200 is positioned to extend obliquely instead of horizontally. This makes it possible to increase a sealing effect against gas flowing back from the downstream side of the stator blade 2B so as to provide enhanced evacuation function.

[Modification]

Figure 7:
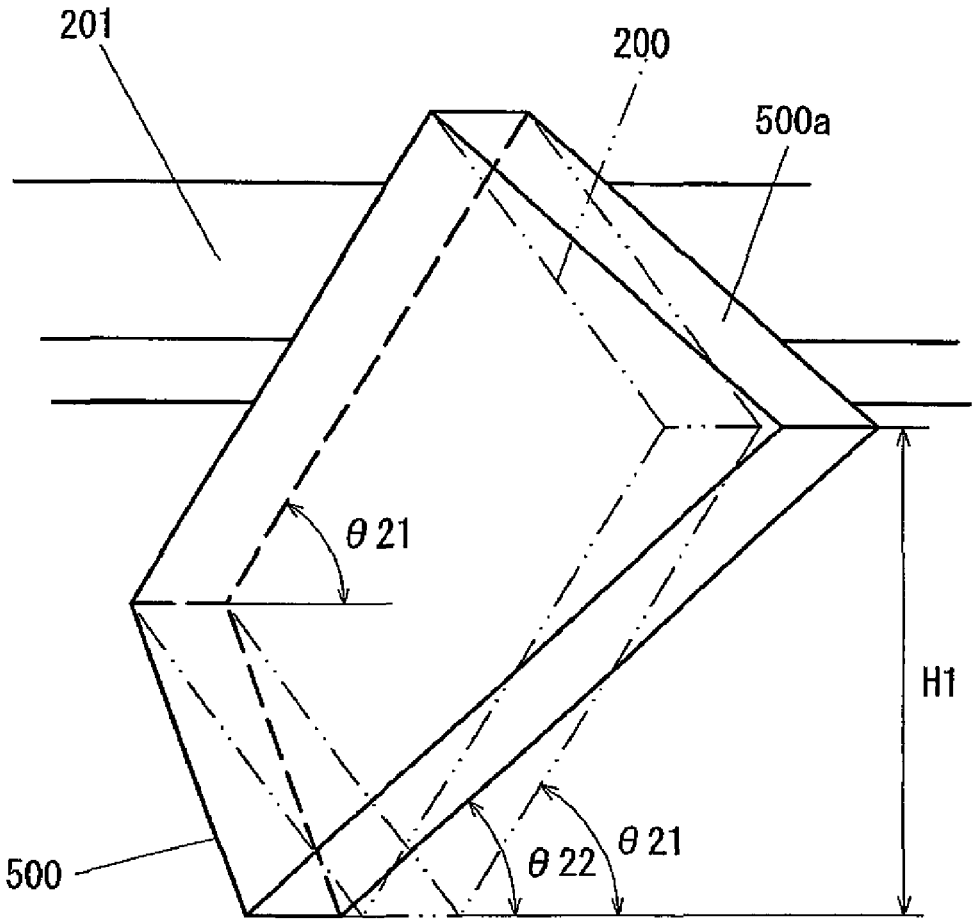
FIG. 7 is a schematic diagram showing a twisted blade element 500.

The aforementioned blade element 200 is formed as a flat blade element having a blade angle set to be constant in the range between an inner peripheral edge and an outer peripheral edge thereof. Alternatively, blade element 200 may be a "twisted blade element" which is designed to have different blade angles at the inner peripheral edge and the outer peripheral edge so as to provide further enhanced evacuation function. FIG. 7 is a perspective view showing the configuration of a blade element 500 of the stator blade 213 formed as the "twisted blade element". The twisted blade element 500 has a blade angle which gradually decreases in a direction from the inner peripheral edge to the outer peripheral edge.

In FIG. 7, the twisted blade element 500 is indicated by a solid line, and the flat blade element 200 is indicated by a two-dot chain line, wherein each of the twisted and flat blade elements 500, 200 is formed to have a blade height of H1. In FIG. 7, the outer peripheral rib portion 202 is omitted. In the twisted blade 500, the blade angle at the inner peripheral edge is set at θ21 which is equal to that of the flat blade element 200, and the blade angle at the outer peripheral edge is set at θ22 (<θ21). As with the flat blade element 200, an upper (upstream) edge surface 500*a* of the twisted blade element 500 is positioned to extend horizontally. A lower (downstream) edge surface of the twisted blade element 500 is also positioned to extend horizontally. The twisted blade element allows an area which permits a person to see through the stator blade 2B from above (i.e., a gap between adjacent ones of the blade elements) to be reduced on the side of the outer peripheral edge. This makes it possible to suppress backflow of gas molecules so as to provide further enhanced evacuation function.

Figure 8:
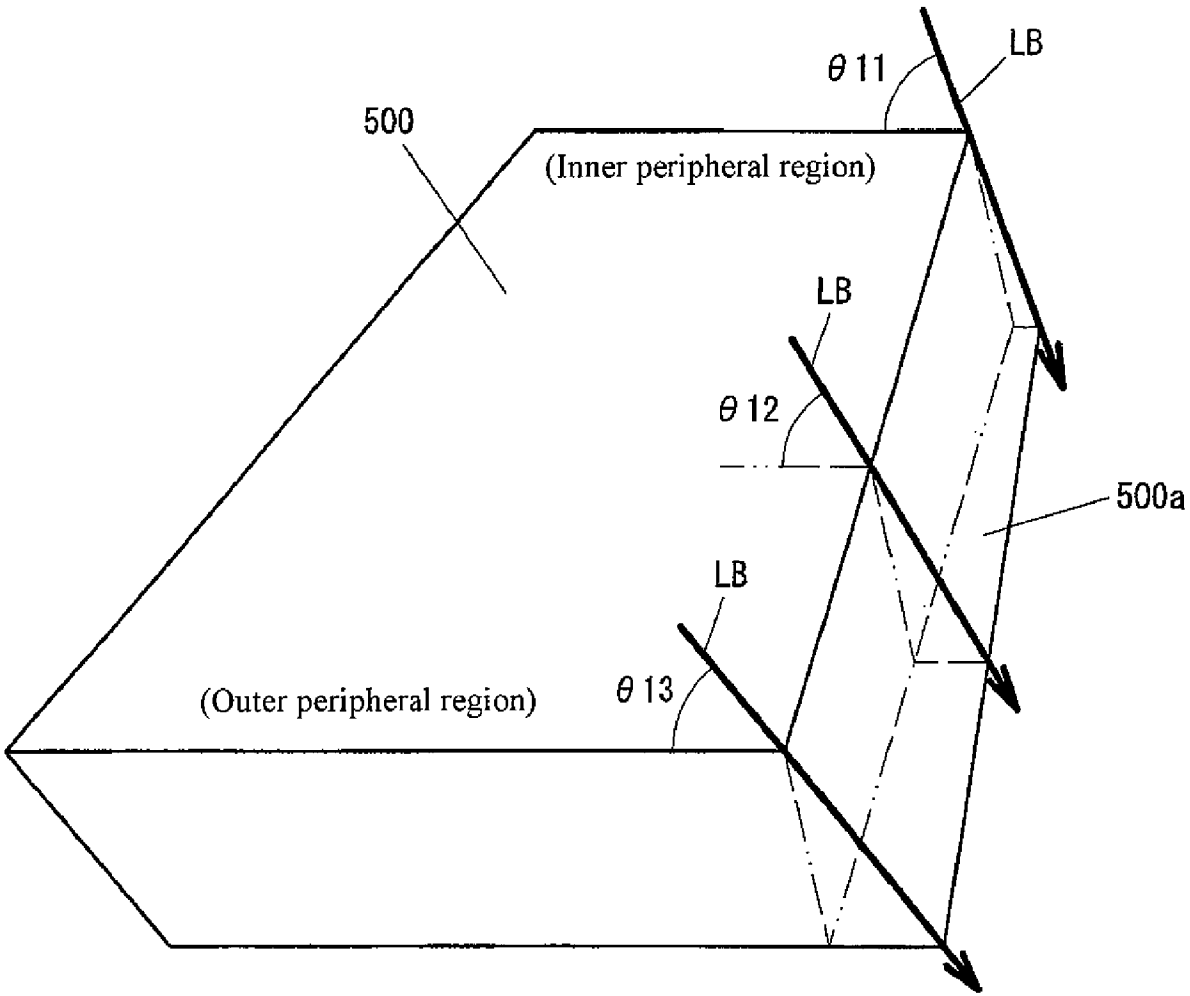
FIG. 8 is a schematic diagram for explaining a beam angle for the twisted blade element 500.

In the twisted blade element 500, the blade angle varies depending on radial positions of the upper edge surface 500*a* thereof, as mentioned above, and thereby the blade angle θ2 is continuously changed in the range of θ21 to θ22. Thus, with a view to forming the upper edge surface of the twisted blade element 500 in such a manner as to be positioned to extend horizontally, the beam angle θ1 may be continuously reduced (i.e., θ11>θ12>θ13) in a direction from an inner peripheral region to an outer peripheral region of the upper edge surface, as shown in FIG. 8.

The above production method of the stator blade 2B has the following advantages which cannot be achieved by the conventional stator blade production method using the punching-based slitting process.

During the punching-based slitting process for the flat blade element 200 illustrated in FIGS. 3 and 4, a punching angle has to be changed between a timing of forming the upper and lower edge surfaces of the blade element 200, and a timing of forming the remaining portions. In addition, the sliding direction of the punch has to be changed for each of the plurality of blade elements 200, because the blade elements 200 are aligned along an arc line. Thus, it is extremely difficult to punch all the slit regions by one cycle of press punching operation. Moreover, in the twisted blade element 500, the angle θ1 is continuously changed depending on the radial positions of the upper edge surface 500*a* as shown in FIG. 8. Thus, it is extremely difficult to form such a surface by the punching-based slitting process. Even if possible, a substantial increase in fabrication cost cannot be avoided.

In contrast, the slitting process using the laser beam LB as in the above embodiment can readily form the slit regions 102 only by changing the angle θ1 of the laser beam LB in respective positions.

While it is desirable to increase a thickness of the metal plate 100 in view of ensuring the rigidity of the stator blade 2B, the metal plate 100 having a thickness of 1 mm or more will lead to a significant increase in fabrication cost of the punching-based slitting process. Moreover, during the punching-based slitting process, a burr is highly likely to be formed, and thereby it is necessary to additionally perform a burr removal operation. In the lasering-based slitting process, the increase in thickness of the metal plate 100 has a small impact on fabrication cost, and there is not any need for a burr removal operation.

In the above embodiment, the laser beam is set at an angle oblique to both the upstream and downstream edge surfaces of the blade element 200 (or 500). Alternatively, the laser beam may be set at an angle oblique to either one of the upstream and downstream edge surfaces, although the evacuation function deteriorates. The magnitude relation between respective blade angles at the inner and outer peripheral edges in the above embodiment may be reversed. It is understood that the present invention is not limited to the above embodiment, but various changes and modifications may be made therein without departing from the spirit and scope thereof as set forth in appended claims.

In a correspondence between the above embodiment and elements of the appended claims, the inner and outer peripheral rib portions 201, 202 correspond to the arc-shaped support portion, and the beam angle θ1 corresponds to the oblique incident angle. This correspondence between the above embodiment and elements of the appended claims is described only by way of example, this description is not meant to be construed in a limiting sense.

What is claimed is:

1. A method of producing a stator blade for use in a turbomolecular pump, comprising:

a slitting step of subjecting a metal plate to a slitting process using a laser beam to form therein an arc-shaped support portion and a blade element supported by said support portion; and an angling step of angling said blade element formed in said slitting step, relative to said support portion, to provide a blade angle to said blade element, wherein said slitting step includes emitting the laser beam onto said metal plate at an incident angle oblique to a principal surface of said metal plate to allow said blade element to have an upstream edge surface and/or a downstream edge surface extending obliquely relative to said principal surface of said metal plate, wherein said blade element is a twisted blade element, wherein said incident angle of said laser beam oblique to said principal surface of said metal plate is set to be different between inner and outer peripheral regions of said upstream edge surface and/or said downstream edge surface of said twisted blade element.

* * * * *